US011353276B2

(12) United States Patent
Urena

(10) Patent No.: US 11,353,276 B2
(45) Date of Patent: Jun. 7, 2022

(54) CANON TUBE COOLING SYSTEM WITH NEBULIZED WATER

(71) Applicant: Kiruna Engineering and Services FZ-LL, Rak (AE)

(72) Inventor: Juan Estrella Urena, Rak (AE)

(73) Assignee: Kiruna Engineering and Services FZ-LL, Rak (AE)

( * ) Notice: Subject to any disclaimer, the term of this patent is extended or adjusted under 35 U.S.C. 154(b) by 0 days.

(21) Appl. No.: 17/270,015

(22) PCT Filed: Aug. 21, 2018

(86) PCT No.: PCT/IB2018/000912
§ 371 (c)(1),
(2) Date: Feb. 20, 2021

(87) PCT Pub. No.: WO2020/039220
PCT Pub. Date: Feb. 27, 2020

(65) Prior Publication Data

US 2021/0325134 A1 Oct. 21, 2021

(51) Int. Cl.
*F41A 13/12* (2006.01)
*F41A 13/04* (2006.01)

(52) U.S. Cl.
CPC ..... *F41A 13/12* (2013.01); *F41A 13/04* (2013.01)

(58) Field of Classification Search
CPC ..... F41A 13/04; F41A 13/12
USPC ..... 89/14.1
See application file for complete search history.

(56) References Cited

U.S. PATENT DOCUMENTS

| | | | | | |
|---|---|---|---|---|---|
| 35,877 | A | | 7/1862 | Hursh | |
| 1,988,449 | A | * | 1/1935 | Hoppert | F41A 13/12 89/14.1 |
| 2,287,066 | A | | 6/1942 | Rogers | |
| 2,388,807 | A | * | 11/1945 | Stephenson | F41A 13/12 89/14.1 |
| 2,764,914 | A | * | 10/1956 | Young | F41A 13/04 89/14.1 |
| 4,753,154 | A | * | 6/1988 | Higashi | F41A 21/44 165/104.26 |
| 5,837,921 | A | * | 11/1998 | Rinaldi | F41A 21/02 89/14.1 |
| 7,926,403 | B1 | * | 4/2011 | Vigil | F41A 13/04 89/7 |
| 2002/0083823 | A1 | * | 7/2002 | Gerber | F41A 13/04 89/1.25 |
| 2003/0167909 | A1 | * | 9/2003 | Matter | F41A 13/10 89/14.1 |
| 2007/0039224 | A1 | | 2/2007 | Skinner | |
| 2010/0192759 | A1 | * | 8/2010 | Garwood | F41A 13/12 89/12 |

OTHER PUBLICATIONS

International Search Report and Written Opinion received for International Application No. PCT/IB2018/000912 dated Jan. 7, 2019, 9 pages.

* cited by examiner

*Primary Examiner* — Bret Hayes
(74) *Attorney, Agent, or Firm* — Benjamin A. Balser; Next IP Law Group

(57) ABSTRACT

Cooling system of a gun canon tube by using water foggers and a jacket that concentrates this water around the outer surface of the canon tube.

5 Claims, 1 Drawing Sheet

CANON TUBE COOLING SYSTEM WITH NEBULIZED WATER

RELATED APPLICATION

This application claims the benefit from International Application No. PCT/IB2018/000912, which was granted an International filing date of Aug. 21, 2018, which is incorporated herein by reference for all purposes.

SECTOR OF THE TECHNIQUE

The present invention pertains to the armament sector and more specifically to 'gun tubes' of weapons It is a system that allows cooling the canon tube of the weapons by means of the use of a device of nebulization of the water contained in an auxiliary deposit.

BACKGROUND OF THE INVENTION

During the firing, part of the heat generated by the combustion of the gunpowder is transferred to the walls of the gun causing the elevation of its temperature.

This rise in temperature can cause the self-ignition (cook-off) of the propulsion charge of a shot unexpectedly, incrementing the possibility of accidents.

On the other hand, the users demand every day increasing performance to their weapons systems and the heating of the tube is one of the factors that more limit the increase of the rate of fire.

Over the years, attempts have been made to address this limitation applying different solutions:

The employment of propellant compositions with lower adiabatic flame temperatures.

Using additives in the gunpowder to reduce the temperature of the gases.

Fitting the canon tube with air cooling fins.

Using systems of rapid replacement of the canon tube in machine guns

Covering the canon tube with a water tank in machine guns

None of these solutions has proven effective.

There are several patents that describe ways of cooling the canyon, of which we highlight one Chinese, CN1372123 and one Korean, KR20110047317. The first uses refrigerant oil and the second use a turbocharger.

There are also 2 Americans, U.S. Pat. Nos. 5,463,926 and 5,511,456, whose owner in both cases is the North American Navy and who are very similar; both mount a system, quite complicated, to circulate a liquid, water or a liquid solution of certain chemical foam.

But there is no one that claims a nebulization system.

DESCRIPTION OF THE INVENTION

It consists of the use of a set of water fogging nozzles. These nozzles surround the tube, so that the mist of water produced wet the entire outer surface of the tube.

Once the tube reaches the temperature of 100 degrees Celsius, the mist of liquid water vaporizes, absorbing during that process 540 cal/g.

To improve the performance of the process, the canon tube, or barrel, is surrounded with a metal jacket or any other material, which prevents the dispersion of the nebulized water. This shirt also has holes along its surface, to evacuate liquid water or generated steam.

Therefore, the system consists of a water tank, a pneumatic or electric drive system, a jacket that surrounds the canon tube, a dispensing flange and a system of tubes of different lengths, which end in nebulizer nozzles.

DESCRIPTION OF A PREFERRED FORM OF EMBODIMENT

On the outside of the canon tube (1) is placed a jacket (2) that keeps the nebulized water in contact with the external surface of the canon tube.

At one end of the canon tube, or barrel, and between the tube and the jacket, there is a delivery flange (4) which acts as a pressurized water injection.

The water pressure is obtained by any available means (by means of an air compressor, by means of an electric pump, etc.)

Figure 1:
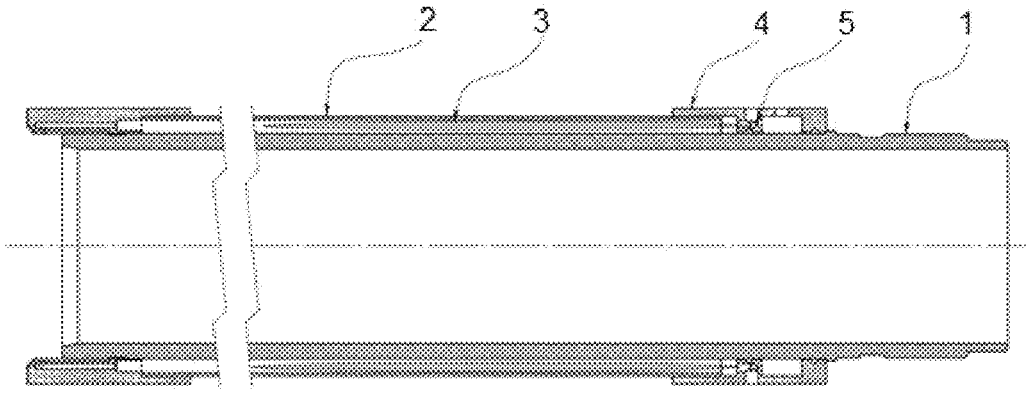
FIG. 1 shows the general arrangement of the system, with all its components adapted to the canon tube.
Figure 2A:
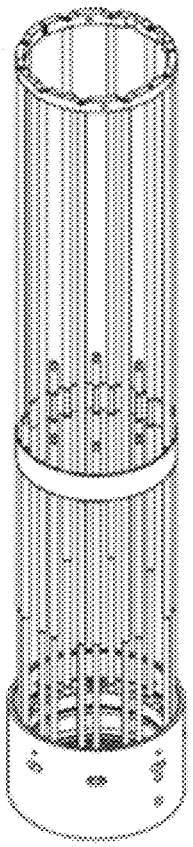
FIGS. 2*a* and 2*b* show a detail of how the delivery flanges and tubes are mounted, in the preferred embodiment, on the outside of the canon tube.
Figure 2B:
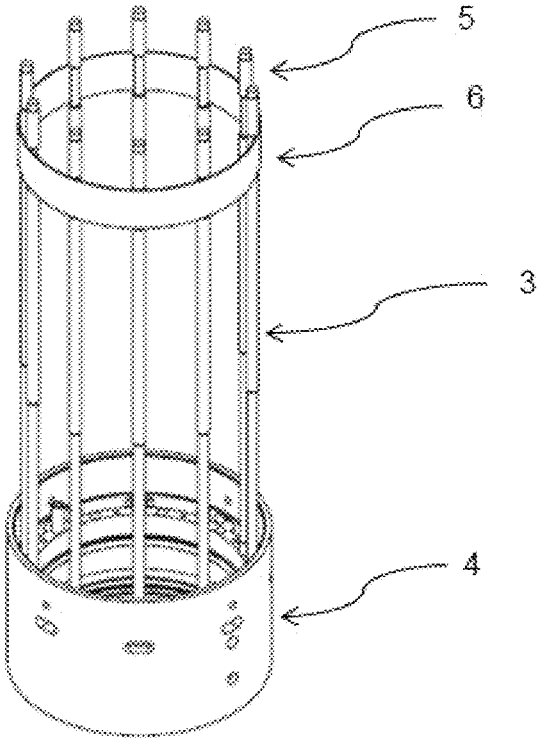

FIGS. 2*a* and 2*b* show the delivery flange (4) and from it a series of tubes (3), equipped with nebulizing nozzles (5).

These tubes are of different lengths so that, mist of droplets of liquid water are deposited along the entire canon tube outer surface.

The jacket has holes so that the water vapor generated also goes into the atmosphere.

The distributor flange has a quick connector to admit the pressurized water that comes from a tank that in its upper part has a pressurized air chamber, generated by a service compressor. The flange (4) is fixed to the lower part of the canon tube (1) and also serves as a support for the outer jacket. The flange has a series of holes in which are mounted alternately, metal tubes (3), which end and/or start all in nebulizer nozzles (5). The length of these is adapted to achieve a better distribution of the nebulized water along the canon tube.

There is an intermediate flange (6) to immobilize the tubes inside the outer jacket. The jacket has holes in the lower part for the evacuation of excess liquid water, and in the upper part for the evacuation of the generated water vapor.

A thermocouple measures the temperature of the tube in the area where more heat is generated. When the thermocouple marks 100 degrees Celsius, it acts on a solenoid valve that puts the pressurized water tank in communication with the distributor flange.

The invention claimed is:

1. A tube cooling system with nebulized water, characterized in that the nebulized water is injected in an outer part of a first tube by means of:

a delivery flange fixed in a lower portion of the first tube, wherein the delivery flange supports the outer jacket; and secondary tubes of different lengths from the delivery flange, wherein the secondary tubes allow mist of droplets of the nebulized water to deposit along an outer portion of the first tube, and wherein the outer jacket encloses the secondary tubes, and a flow of the nebulized water circulating between the outer portion of the first tube and the outer jacket is continuous after a moment in which a thermocouple detects a temperature of 100° Celsius and opens a solenoid valve, allowing a passage of the nebulized water.

2. The tube cooling system with the nebulized water according to claim 1, characterized by the delivery flange has a series of holes receiving the secondary tubes.

3. The tube cooling system with the nebulized water according to claim 1, characterized in that the delivery flange is used as a support, together with another intermediate flange, for the outer jacket.

4. The tube cooling system with the nebulized water according to claim 2, characterized in that the tubes are equipped with nebulizing nozzles at ends of the secondary tubes.

5. The tube cooling system with the nebulized water according to claim 1, characterized in that the outer jacket is parallel to the first tube along a full length of the first tube, with a coupling area for the delivery flange and holes in the outer jacket for evacuation of the nebulized water or generated vapor.

* * * * *